US007841273B2

(12) United States Patent
Splinter et al.

(10) Patent No.: US 7,841,273 B2
(45) Date of Patent: Nov. 30, 2010

(54) ROLLER BEARING IN A ROLLER PRESS

(75) Inventors: Christian Splinter, Pulheim (DE); Meinhard Frangenberg, Kürten-Engeldorf (DE)

(73) Assignee: KHD Humboldft Wedag GmbH, Cologne (DE)

( * ) Notice: Subject to any disclaimer, the term of this patent is extended or adjusted under 35 U.S.C. 154(b) by 401 days.

(21) Appl. No.: 11/629,374

(22) PCT Filed: Jun. 10, 2005

(86) PCT No.: PCT/EP2005/006228

§ 371 (c)(1),
(2), (4) Date: Aug. 7, 2007

(87) PCT Pub. No.: WO2005/120815

PCT Pub. Date: Dec. 22, 2005

(65) Prior Publication Data

US 2008/0017052 A1 Jan. 24, 2008

(30) Foreign Application Priority Data

Jun. 12, 2004 (DE) ..... 10 2004 028 670

(51) Int. Cl.
*B30B 3/04* (2006.01)

(52) U.S. Cl. ..... 100/168; 100/170; 100/176; 241/231

(58) Field of Classification Search ..... 100/168, 100/169, 170, 172, 173, 176; 241/226, 227, 241/230–235
See application file for complete search history.

(56) References Cited

U.S. PATENT DOCUMENTS

| | | | | |
|---|---|---|---|---|
| 3,899,965 | A | 8/1975 | Koch et al. | |
| 3,936,258 | A * | 2/1976 | Lake | 425/135 |
| 4,926,666 | A | 5/1990 | Gotting et al. | |
| 4,997,358 | A * | 3/1991 | Perkins et al. | 425/194 |
| 5,048,411 | A | 9/1991 | Siebert | |
| 5,261,324 | A * | 11/1993 | Jakobs et al. | 100/158 R |

FOREIGN PATENT DOCUMENTS

| | | |
|---|---|---|
| DE | 3825716 | 2/1990 |
| DE | 4034822 | 4/1992 |
| JP | 04131146 | 5/1992 |

* cited by examiner

*Primary Examiner*—Jimmy T Nguyen
(74) *Attorney, Agent, or Firm*—Greer, Burns & Crain, Ltd.

(57) ABSTRACT

The aim of the invention is to simplify and to improve mounting of roller bearings in double roller machines, for example, roller presses for interparticle comminution of granular goods. The rollers and the bearing housing thereof are formed by means of slanting rollers and/or thermal roller longitudinal changes. The rollers are guided in a secure manner on the slide guides thereof. The invention is characterized in that the fixed bearing housing and the moveable bearing housing are connected together via a guide rod in each roller.

10 Claims, 3 Drawing Sheets

ROLLER BEARING IN A ROLLER PRESS

BACKGROUND OF THE INVENTION

The invention relates to a twin-roller machine for the pressure treatment of granular material, in particular a roller press for material-bed comminution or compacting or briquetting, with two rollers which are rotatably mounted in a machine frame, are oppositely driven and are separated from each other by a roller nip, at least one of which rollers is formed as a movable roller which is movable transversely in relation to the roller nip and the bearing housings of which are supported on frame side parts by means of hydraulic cylinders, the bearing housings being mounted with their undersides on level slideways of machine brackets.

In the case of such twin-roller machines, the movable roller lies with its bearing housings on the slideways of the two spaced-apart brackets, where it can slide back and forth transversely in relation to the roller nip with its bearing housings by means of sliding plates, a slanting roller position with a non-parallel roller nip also being possible. This roller mobility may be accomplished by relatively costly spherical roller bearings installed in the bearing housings, with which however the bearing seals are subjected to excessive stresses and soiled sealing grease may be undesirably sucked into the gaping and increasingly large labyrinthine gap if the rollers are made to slant to any great extent, and with which the bearing housings are axially fixed, for example by means of adjusting springs. Spherical roller bearings also cannot readily compensate for thermal changes in the length of the rollers.

DE 40 34 822 C2 discloses a twin-roller machine of the generic type in the bearing housings of which not spherical roller bearings but more simple multi-row cylindrical roller bearings are installed. To make it possible for the rollers to be made to slant here, the bearing housings have vertical arms with pivot pins attached to the end, which are guided in a pivotally movable manner in slotted guides that are arranged on the outside of the machine frame and have sliding guide slots. This construction allows the rollers to be made to slant and also to undergo thermal expansion without causing the bearing seals to gape.

SUMMARY OF THE INVENTION

The invention is based on the object of simplifying the roller bearing in twin-roller machines of the type stated at the beginning, in particular in terms of assembly, and also to improve it in such a way that the roller movements are guided in a statically defined manner with all degrees of freedom of the rollers and their bearing housings, brought about by a slanting roller position and/or thermal changes in the length of the rollers.

This object is achieved according to the invention by a twin-roller machine for the pressure treatment of granular material, having two rollers mounted in a machine frame to rotate about approximately parallel axes, arranged to be oppositely driven and separated from each other by a roller nip. At least one of the rollers mounted as a laterally movable roller. Bearing housings are located at each end of each of the two rollers. The bearing housings for the movable roller are supported on frame side parts by hydraulic cylinders and are mounted with their undersides on level slideways of machine brackets. One of the bearing housings for each roller is an axially fixed bearing housing and the other bearing housing for each roller allows axial movement of that roller. For each roller, the axially fixed bearing housing and the bearing housing allowing axial movement are connected to each other by a guide rod.

In the twin-roller machine according to the invention, it is no longer the case that all four bearing housings are guided by means of vertical arms in slotted guides with a sliding guide slot on the machine frame, but only the fixed bearing housings of the fixed roller and the movable roller. In this case, for each roller the fixed bearing housing and the movable bearing housing are respectively connected to each other by a guide rod, i.e. the movable bearing housing whose cylindrical roller bearing allows thermal changes in the length of the roller in the axial direction is guided by the fixed bearing housing directly via the guide rod. This means that the movable bearings and their bearing housings are not fixed and are nevertheless guided by means of the respective guide rod. The guide rods are arranged approximately parallel to the roller nip and advantageously under the rollers, to be precise with a sufficiently great distance from the roller nip, so that the guide rods cannot disturb the flow of material passed through the roller nip.

A further advantage of the guide rods respectively connecting the fixed bearing housing and the movable bearing housing lies in the simpler assembly and disassembly of the roller units, which comprise the roller and bearing housings pushed onto the bearing journals of the latter, for example by means of a crane in the case where a roller is changed, the bearing housing with the axially unfixed movable bearing not being able to slip off from the associated bearing journal because of the guide rod. In any event, the guide rod allows the rollers to be made to slant, the cylindrical roller bearings and the roller shaft remaining axially parallel even in slanted roller positions, thereby excluding the possibility of the bearing seals and labyrinthine bearing gaps gaping when the roller is made to slant.

According to one particular feature of the invention, the guide rods respectively have at their ends a pivot with a connecting arm, which acts on the respectively neighboring bearing housing. In this way, the guidance of the bearing housings comprising the movable bearings is accomplished particularly effectively in the event of a thermal change in the length of the roller and/or a slanting position of the roller. Furthermore, as a result, the system remains statically defined.

The guide rods respectively used for each roller according to the invention allow the distances between the bearing housings that are pushed onto the bearing journals to be definitively set at the workshop. There is no need for any further setting and aligning work at the installation site of the roller press or roller mill, as a result of which the assembly effort is reduced and the time it takes to exchange worn rollers is considerably reduced. Because the movable bearing housings are no longer guided by means of sliding-guide slotted links on the machine frame, in the twin-roller machine according to the invention the accuracy requirements in the production of the machine frame are reduced, which is of advantage in particular when the machine frame is produced elsewhere.

The guide rod for connecting the fixed bearing housing and the movable bearing housing may be adjustable in length, for example equipped with a turnbuckle, to make it easy to compensate for the production tolerances.

Instead of the fixed bearing housing, the axially fixed gear mechanism, such as for example the slip-on gear mechanism of the roller drive or of the associated torque counteracting support, may also be used for the movable bearing housing to be axially guided by the tie rod.

Because gaping of the bearing seals and labyrinthine gaps is no longer possible when the rollers are made to slant in the twin-roller machine according to the invention, such as for example a roller press, instead of being equipped with cylindrical roller bearings, it is also possible for them to be equipped with spherical roller bearings together with circulating oil lubrication and also with other angle-adjustable types of bearing, in principle also with comparable sliding bearings. To achieve the static definition here, the guide rod is rigidly connected to the fixed bearing housing.

BRIEF DESCRIPTION OF THE DRAWINGS

The invention and further features and advantages thereof are explained in more detail on the basis of the exemplary embodiment that is schematically represented in the drawing, in which.

DETAILED DESCRIPTION OF THE PREFERRED EMBODIMENTS

Figure 1:
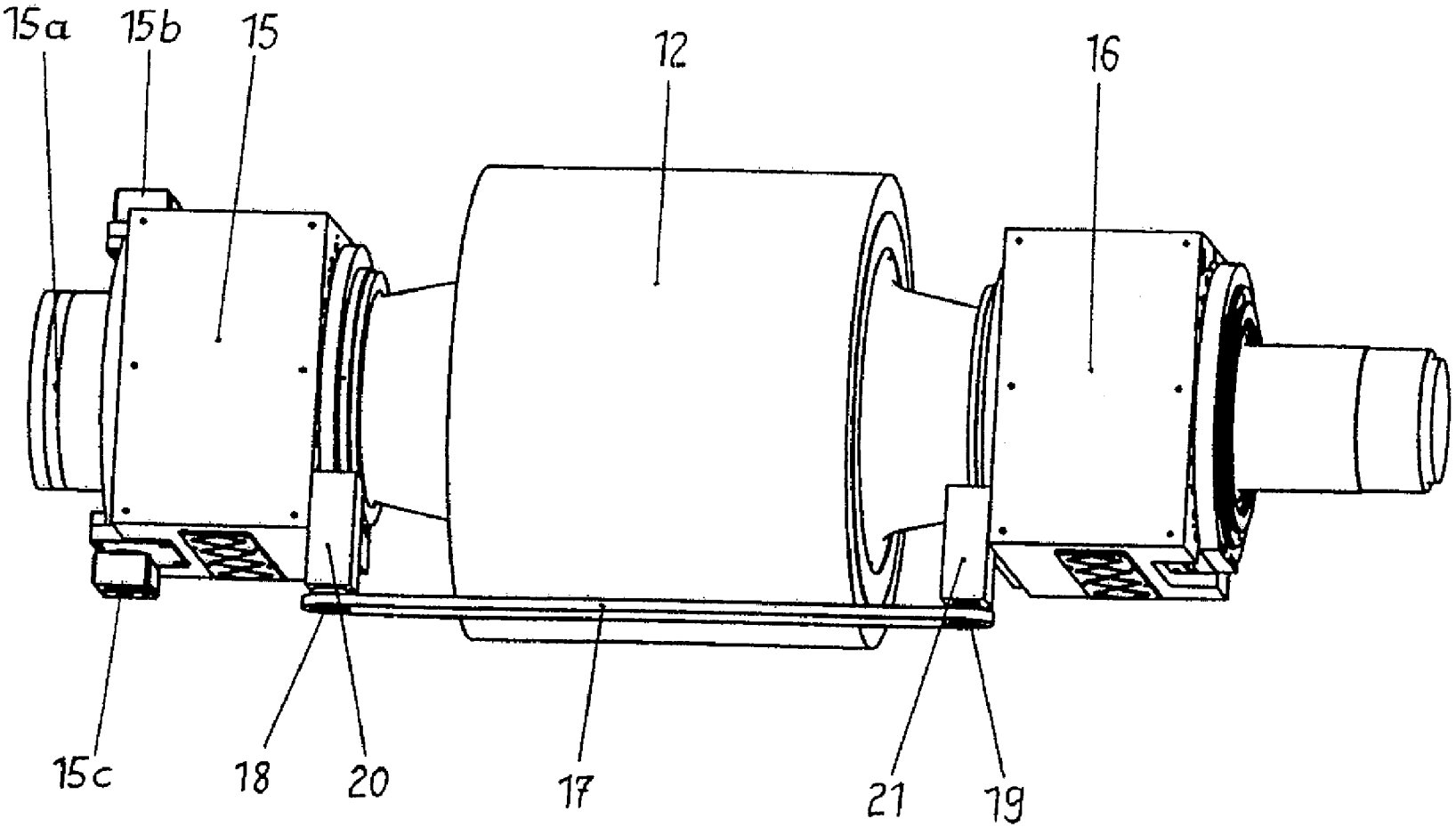
FIG. 1 shows, drawn separately, a roller of a roller press for pressure comminution of granular material, the roller forming an assembly unit with bearing housings pushed onto the bearing journal.
Figure 2:
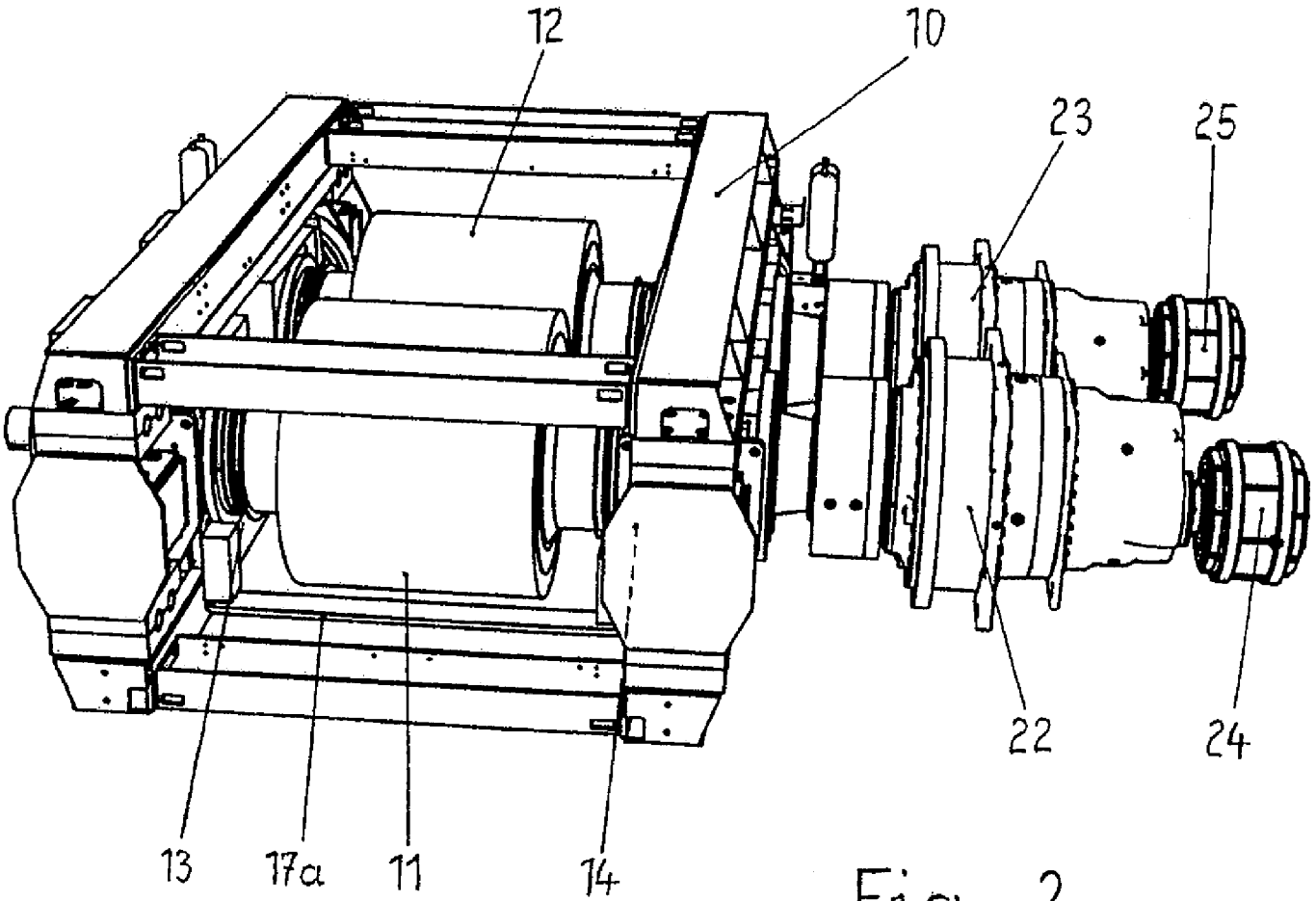
FIG. 2 shows, likewise in a perspective view, a roller press with its main parts, with two installed rollers.
Figure 3:
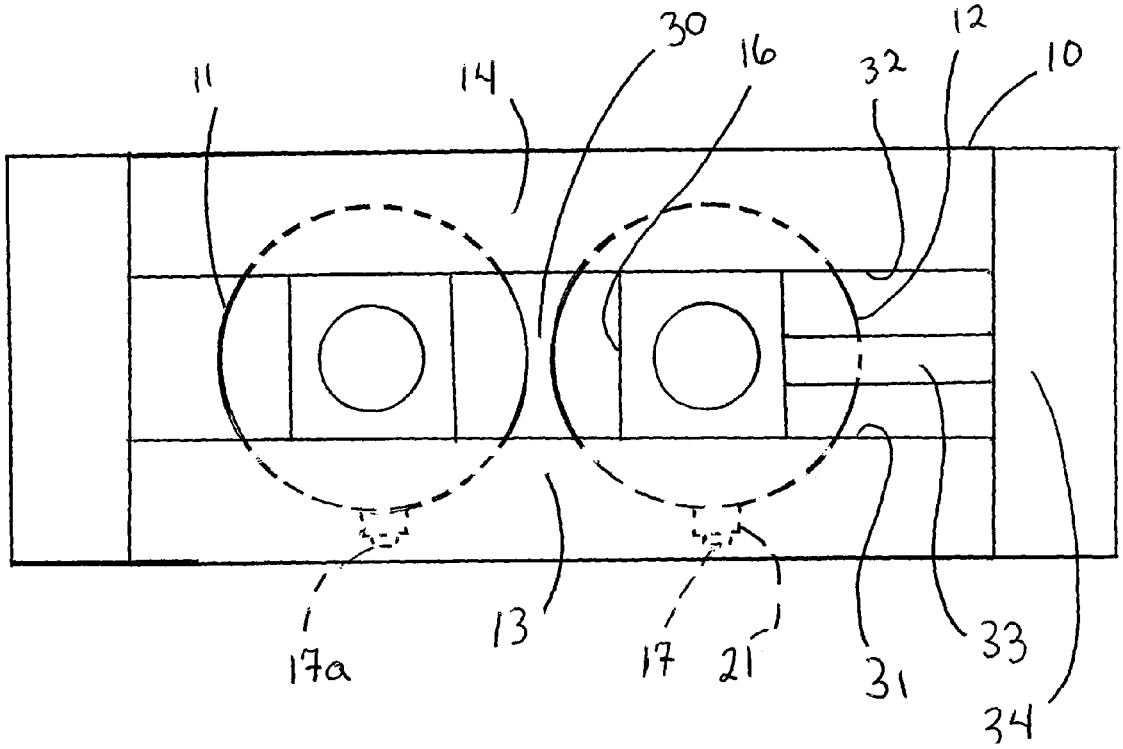
FIG. 3 shows schematically, from an end view, the movable bearing housing mounted on the slideways and supported on hydraulic cylinders.

According to FIG. 2, the roller press has a machine frame 10, in which two oppositely rotating rollers 11, 12 are rotatably mounted, which form between them a roller nip 30 and one of which, for example the front roller in FIG. 2, is formed as a fixed roller 11 and the other of which, the rear roller in FIG. 2, is formed as a movable roller 12, the latter of which is drawn separately in FIG. 1. Both rollers have bearing journals, which are mounted in rolling bearings, in particular cylindrical roller bearings, which in turn are arranged in bearing housings. While the fixed roller 11 is supported with its two bearing housings directly on the front machine frame side parts and rests on two brackets 13, 14 of the machine frame 10, the movable roller 12 rests with its bearing housings 15 and 16 likewise on slideways 31, 32 of these two spaced-apart brackets 13 and 14, where it can slide back and forth transversely in relation to the roller nip 30 with its bearing housings 15, 16 by means of sliding plates. The transversely movable bearing housings 15 and 16 are supported on hydraulic cylinders 33, with which the roller pressing force is applied in order to subject the material that is located in the roller nip 30 and is to be comminuted to pressure, the hydraulic cylinders in turn being supported on rear machine frame side parts 34.

The rolling bearing arranged in the bearing housing 15 is formed by means of an additional axial bearing 15*a* as an axially fixed bearing and the rolling bearing installed in the bearing housing 16 is formed as an axially movable bearing, which allows a thermal change in the length of the roller and hence, allows for axial movement of that roller. In practical operation of the roller press, slanting roller positions may occur, for example on account of the roller nip 30 being unevenly charged with feedstock, and lead to the bearing housings sliding on the slideways of the brackets.

The axially fixed bearing housing 15 of the movable roller 12 and the neighboring fixed bearing housing of the fixed roller 11 are axially guided on the machine frame, for example by means of slotted guidance with pivot pins 15*b*, 15*c* in a sliding guide slot, yet still retaining the other degrees of freedom of the bearing housings, namely movement transversely in relation to the roller nip 30 while permitting slanting roller positions.

For reliable guidance of the bearing housings on their slideways 31, 32, the invention provides that for each roller the axially fixed bearing housing 15 and the movable bearing housing 16 are respectively connected to each other by a guide rod 17, 17*a*, which is arranged approximately parallel to the roller nip 30, advantageously under the rollers, so that the guide rods do not disturb the flow of material through the roller nip. In order to permit the sliding of the bearing housings in all degrees of freedom, according to a further feature of the invention the guide rods 17, 17*a* respectively have at their ends a pivot 18, 19 with in each case a connecting arm 20, 21, which extends approximately at right angles and acts on the respectively neighboring bearing housing 15 or 16. The rollers with their respective bearing housings 15, 16 and with the guide rod 17 in each case form a structural unit (shown in FIG. 1) that is produced and aligned in the workshop, the guide rod 17 also preventing the movable bearing housing 16 from slipping off the roller journal while such a structural unit is being transported, i.e. the guide rod 17 at the same time represents an assembly aid when the roller press according to the invention is being assembled and when worn rollers are being exchanged.

The fact that the movable bearing housing 16 is guided by the axially fixed bearing housing 15 via the guide rod 17 means that the bearing sealing gaps or labyrinthine gaps remain unchanged in the event of slanting roller positions, which not only has positive effects on the lifetime of the bearing seals but also permits the consistent use of a circulating oil lubrication of the bearings.

In FIG. 2 it can also be seen that the bearing journals respectively on the right of the fixed roller 11 and the movable roller 12 have on them slip-on gear mechanisms 22, 23 with couplings 24, 25, by means of which the motor drive of the two rollers takes place.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

The invention claimed is:

1. A twin-roller machine for the pressure treatment of granular material, comprising:

two rollers mounted in a machine frame to rotate about approximately parallel axes which define an axial direction, arranged to be oppositely driven and separated from each other by a roller nip;

at least one of the rollers mounted as a laterally movable roller;

bearing housings located at each end of each of the two rollers, the bearing housings for the movable roller being supported on frame side parts by hydraulic cylinders for movement transverse to the axes and being mounted with their undersides on level slideways of machine brackets, one of the bearing housings for each roller having a rolling bearing fixed in the axial direction and the other bearing housing for each roller having a rolling bearing which is movable in the axial direction allowing axial movement of that roller; wherein for each roller, the axially fixed bearing housing and the movable bearing housing allowing axial movement are connected to each other by a guide rod.

2. The twin-roller machine as claimed in claim 1, wherein the guide rods are arranged approximately parallel to the roller nip, under the rollers.

3. The twin-roller machine as claimed in claim 1, wherein each guide rod has at its ends a pivot with a connecting arm, which acts on the respectively neighboring bearing housing.

4. The twin-roller machine as claimed in claim 1, further including slip-on gear mechanisms engageable with bearing journals of the two rollers.

5. A twin-roller machine for the pressure treatment of granular material, comprising:

two rollers mounted in a machine frame to rotate about approximately parallel axes which define an axial direction, arranged to be oppositely driven and separated from each other by a roller nip;

at least one of the rollers mounted as a laterally movable roller;

bearing housings located at each axial end of each of the two rollers, one of the bearing housings for each roller having a rolling bearing fixed in the axial direction and the other bearing housing for each roller having a rolling bearing which is movable in the axial direction allowing axial movement of that roller within the bearing housing; and a guide rod connecting the axially fixed bearing housing and the movable bearing housing allowing axial movement of each roller.

6. The twin-roller machine as claimed in claim 5, wherein the bearing housings for the movable roller are supported on frame side parts by hydraulic cylinders.

7. The twin-roller machine as claimed in claim 5, wherein the bearing housings for the movable roller are mounted with their undersides on level slideways of machine brackets.

8. The twin-roller machine as claimed in claim 5, wherein the guide rods are arranged approximately parallel to the roller nip, under the rollers.

9. The twin-roller machine as claimed in claim 5, wherein each guide rod has at its ends a pivot with a connecting arm, which acts on the respectively neighboring bearing housing.

10. The twin-roller machine as claimed in claim 5, further including slip-on gear mechanisms engageable with bearing journals of the two rollers.

* * * * *